US006666743B2

(12) United States Patent
Polare et al.

(10) Patent No.: US 6,666,743 B2
(45) Date of Patent: Dec. 23, 2003

(54) SPINNING TOP

(75) Inventors: Carrie L. Polare, Pacific Palisades, CA (US); Daniel T. Hoffman, Malibu, CA (US); Paul B. Thomas, San Pedro, CA (US); Robert D. Leventhal, Los Angeles, CA (US)

(73) Assignee: Sport Fun, Inc., Los Angeles, CA (US)

( * ) Notice: Subject to any disclaimer, the term of this patent is extended or adjusted under 35 U.S.C. 154(b) by 64 days.

(21) Appl. No.: 10/003,019

(22) Filed: Oct. 23, 2001

(65) Prior Publication Data

US 2003/0077977 A1 Apr. 24, 2003

(51) Int. Cl.[7] ..... A63H 1/00
(52) U.S. Cl. ..... 446/256; 446/242
(58) Field of Search ..... 273/147; 446/242, 446/247, 248, 256, 257, 259, 261, 262, 263, 264, 266

(56) References Cited

U.S. PATENT DOCUMENTS

| | | | | | |
|---|---|---|---|---|---|
| 190,421 | A | * | 5/1877 | Davis | |
| 1,361,637 | A | * | 12/1920 | Steen | |
| 3,803,757 | A | * | 4/1974 | Sanchez | 46/228 |
| 3,879,887 | A | * | 4/1975 | Brookson, Jr. et al. | 46/67 |
| 4,304,064 | A | * | 12/1981 | Kulesza et al. | 46/68 |
| 5,020,798 | A | * | 6/1991 | Yang | 273/440 |
| 5,356,328 | A | * | 10/1994 | Ho | 446/242 |
| 6,083,076 | A | * | 7/2000 | Saint-Victor | 446/242 |
| 6,146,233 | A | * | 11/2000 | Hedeen, Jr. | 446/261 |
| 6,443,801 | B1 | * | 9/2002 | Bell | 446/256 |

* cited by examiner

*Primary Examiner*—Jacob K. Ackun
*Assistant Examiner*—Jamila Williams
(74) *Attorney, Agent, or Firm*—Fulwider Patton, et al.; Ellsworth R. Roston

(57) ABSTRACT

A hollow rotatable member preferably made from a clear plastic material and a hollow cover are attached to each other in a spinning top. A ring is disposed within the top on the cover at a position of the top's substantially maximum diameter to provide stability and inertia to the top during the top's rotation, thereby significantly increasing the top's spinning time. A cap fits tightly on the upper portion of the rotatable member. A strap having teeth defining a rack gear extends through an aperture in the cap and engages a pinion gear in the aperture. When the strap is pulled from the aperture, the pinion gear rotates and causes the top to spin. Because of the tight fit between the top and the cap, the top can be thrown outwardly and downwardly toward a support surface and can be spinning as it reaches the support surface. The cap may have an increased vertical dimension to facilitate the manual holding of the top in a vertical direction when the strap is pulled from the cap aperture to initiate the top's spinning. Lights may be disposed within the rotatable member to provide illuminations while the top is spinning. A belt is disposed on the cover at substantially the position of the seam between the rotatable member and the cover and is provided with a significant height to receive advertisements. Depending upon their positioning and configuration, lugs on the belt also enhance the top's stability and balance or destabilize and unbalance the top. Each user may have a plurality of as collectible items belts with different configurations of lugs. The lugs strike competitive tops and prevent them from spinning.

39 Claims, 4 Drawing Sheets

SPINNING TOP

This invention relates to spinning tops. More particularly, the invention relates to tops which provide an enhancement in the spinning time and which provide a competitive advantage when different tops compete by intentional collisions to determine which top will spin the longest.

BACKGROUND OF THE PREFERRED EMBODIMENTS OF THE INVENTION

Tops have existed for decades as toys for children. At the beginning, the tops were made from wood and were spun by winding a string on the body of the top, holding the free end of the string and releasing the top or projecting the top toward a support surface. The top became progressively unwound from the string before reaching the support surface and spun when it hit the support surface.

In more recent years, improvements have been provided in the implementation of the top to produce a spinning of the top. For example, a cap has been disposed on the top and has been provided with an aperture and a pinion gear in the aperture. A strap having teeth at one end to define a rack gear has been disposed in the aperture to become coupled to the pinion gear. When the strap has been pulled through the aperture, it has caused the gear to rotate. The gear in turn has caused the top to rotate. An advantage of this arrangement has been that the top has been disposed on a support surface and that the strap has been pulled from the aperture while the top has been disposed on the support surface.

Even with the advances in the tops as specified in the previous paragraph, children have been, and still are, seeking other advantages in the operation of the top. For example, children are always seeking to lengthen the period of time during which the top spins. Children are also interested in using the tops as offensive toy weapons in competitive games involving toys by having their tops bump other tops and prevent the other tops from spinning while their toys continue to spin.

BRIEF DESCRIPTION OF PREFERRED EMBODIMENTS OF THE INVENTION

A hollow rotatable member preferably made from a clear plastic material and a hollow cover are attached to each other in a spinnable top. A ring is disposed within the top on the cover at a position of the top's substantially maximum diameter to provide stability and inertia to the top during the top's rotation, thereby significantly increasing the top's spinning time.

A cap fits tightly on the upper portion of the rotatable member. A strap having teeth defining a rack gear extends through an aperture in the cap and engages a pinion gear in the aperture. When the strap is pulled from the aperture, the pinion gear rotates and causes the top to spin. Because of the tight fit between the top and the cap, the top can be thrown outwardly and downwardly to a support surface and can be spinning as it reaches the support surface.

A belt is disposed on the cover at the position of the seam between the rotatable member and the cover. Depending upon their positioning and configuration, lugs on the belt also enhance the top's stability and balance or destabilize and unbalance the top. Each player may have as collectible items a plurality of different belts with different lug configurations. The lugs strike competitive tops and prevent them from spinning. The belt may be provided with an increased height to facilitate the disposition of graphics (e.g., advertisements) on the belts. The graphics enhance the desire of children to consider the belts as collectible items.

The cap may have an increased vertical dimension to facilitate the manual holding of the top in a vertical direction when the strap is pulled from the cap aperture to initiate the top's spinning. This increased vertical dimension of the cap prevents the user from interfering with the strap when the cap is pulled from the cap aperture. It also provides for a vertical disposition of the top on the support surface while the top is spinning. Lights may be disposed within the rotatable member to provide illuminations while the top is spinning.

DETAILED DESCRIPTION OF PREFERRED EMBODIMENTS OF THE INVENTION

Figure 2:
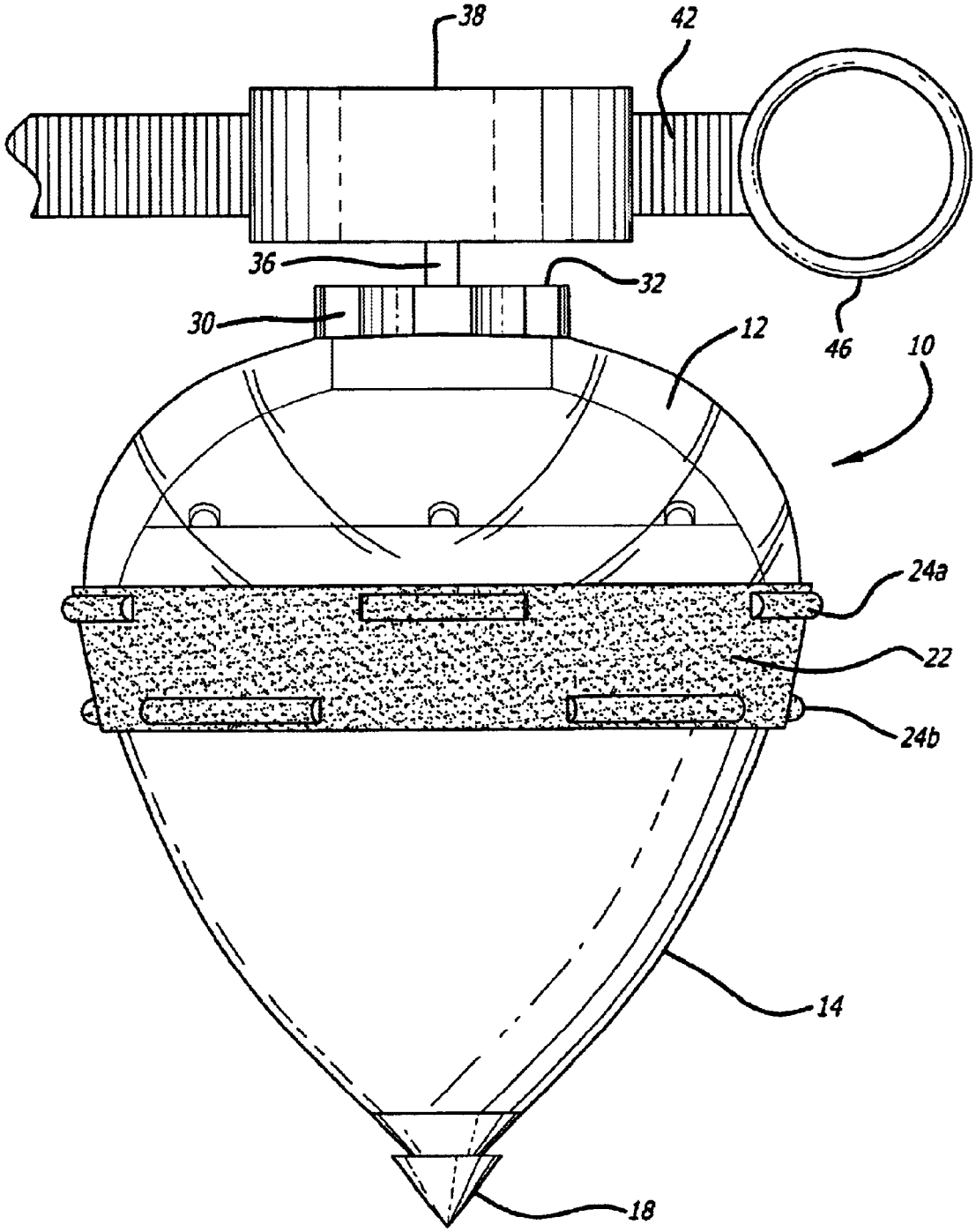
FIG. 2 is an enlarged front elevational view of the top and shows a strap in a position to be pulled for producing a spinning of the top.

In a preferred embodiment of the invention, a top generally indicated at 10 is provided to spin on a support surface. The top 10 includes a rotatable member 12 (FIG. 2) which may be made from a suitable material (e.g. polyurethane) and which may be provided with substantially a frusto-conical configuration. A hollow cover 14 also having a frusto-conical configuration is disposed on the rotatable member 12 and is suitably attached to the rotatable member as by screws 16. The cover 14 may be preferably made from a strong non-scuffable metal such as stainless steel to provide protection such as against scuffing of the rotatable member 12 and to enhance the aesthetics of the top.

Figure 5:
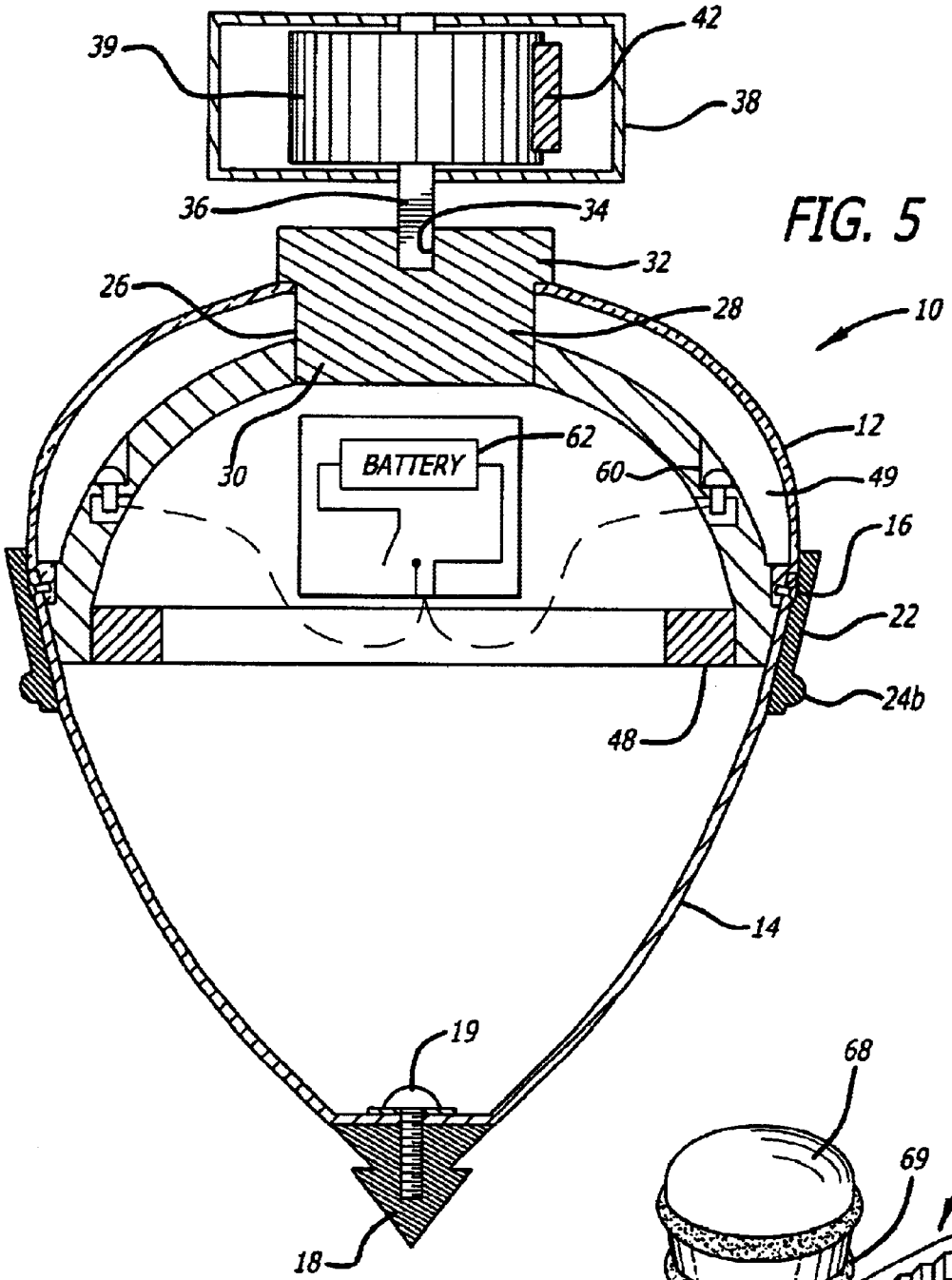
FIG. 5 is a sectional view taken substantially on the line 5—5 of FIG. 3 with the cap disposed tightly on the top and the strap disposed in the aperture in the cap in a position to be pulled from the cap and additionally shows an improvement in the top shown in the previous Figures.

A tip 18 (FIGS. 2 and 5) preferably made from a suitable material such as nylon extends downwardly from the bottom of the cover 14 to facilitate the spinning movement of the top 10 on a support surface. Nylon is advantageous for use as the tip 18 because it has a low friction on a support surface and thereby extends the time during which the top can spin on the support surface. The tip 18 is removably attached to the cover 14 as by a screw 19 (FIG. 5). In this way, the tip 18 may be replaced with another tip when the tip 18 becomes pitted from extended use. Other low friction materials than nylon may also be used as the tip 18.

Figure 3:
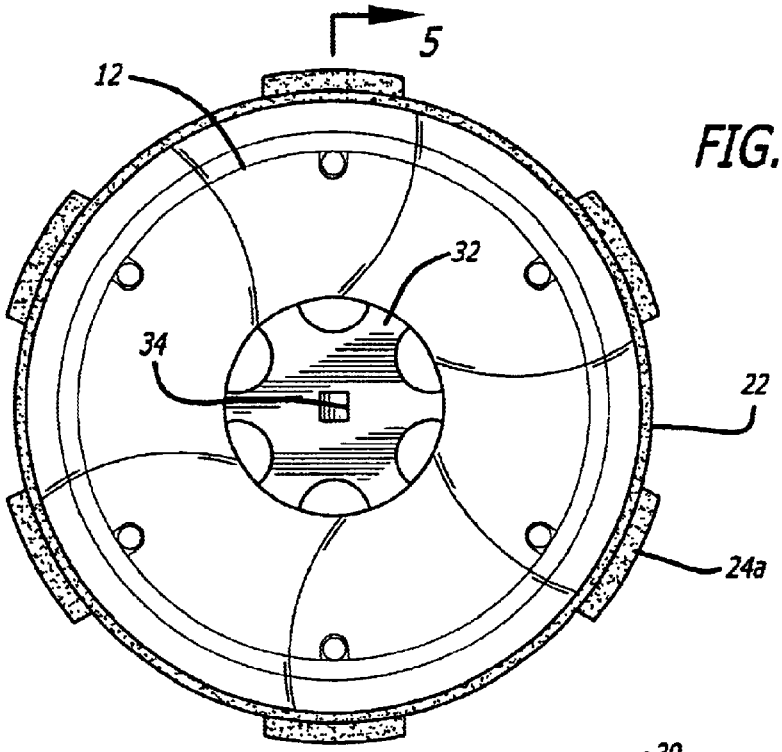
FIG. 3 is a top plan view of the top.

A belt 22 (FIGS. 2 and 3) preferably made from a suitable plastic material such as a polyurethane or a thermoplastic rubber is removably disposed on the rotatable member 12 and the cover 14 for disposition over the seam between the rotatable member and the cover. The belt 22 is provided with lugs 24*a* and 24*b* respectively disposed near the top and bottom of the belt at spaced positions around the annular periphery of the belt. The annular positioning of the lugs 24*a* is preferably disposed in a staggered relationship to the annular positioning of the lugs 24*b* and are preferably equally spaced in the annular direction around the periphery of the band. Preferably the same annular spacing is provided for the lugs 24*b* as for the lugs 24*a* when the top is to be provided with a balanced construction. However, a different arrangement may be provided for the lugs 24*b* than for the lugs 24*a* when the top 10 is to have an unbalanced relationship. Different unbalances may be provided for the top 10 by providing a plurality of belts, each having a different configuration of the lugs 24*a* and 24*b*.

The rotatable member 12 is provided at its upper end with a cavity 26 (FIG. 5) to receive a body portion 28 of a support member 30 preferably made from a suitable material such as polyurethane. The body portion 28 is retained in the cavity 26 by any suitable means such as an adhesive. A head portion 32 on the support member 30 extends above the upper end of the rotatable member 12. The head portion 32 has a socket 34 which is shaped to receive a pin 36 having a substantially tight fit in the socket.

Figure 4:
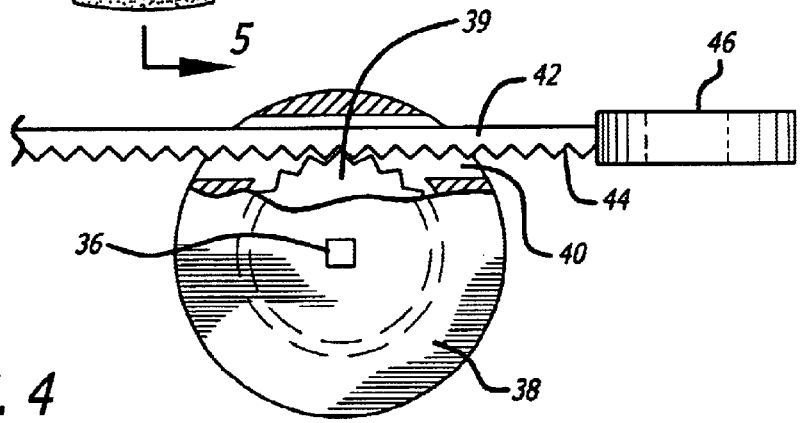
FIG. 4 is a bottom plan view, partially broken away, of a cap for receiving the strap and for producing a spinning of the top when the strap is pulled from an aperture in the cap.

The pin 36 is integral with a cap 38 which extends above the pin. The cap 38 preferably has a cylindrical configuration and sits on the head portion 32 of the support member 30. The cap 38 has an aperture 40 (FIG. 4) which extends through the cap and preferably emerges at opposite ends at positions annularly spaced from each other by an angle less than 180 degrees. A pinion gear 39 is disposed within the aperture 40 in the cap 38.

A strap 42 preferably made from a plastic material such as a polystyrene extends through the aperture 4D. The strap 42 is freely slidable in the aperture 40 when the cap 38 is not disposed on the support member 30. In this way, the strap 42 can be fully passed through the aperture 40 before the cap 38 is disposed on the support member 30. The strap 42 is provided with teeth 44 at one of its surfaces. The teeth 44 engage the pinion gear 39 when the cap 38 is disposed on the support member 30 and the top 10 is to be operated.

Figure 1:
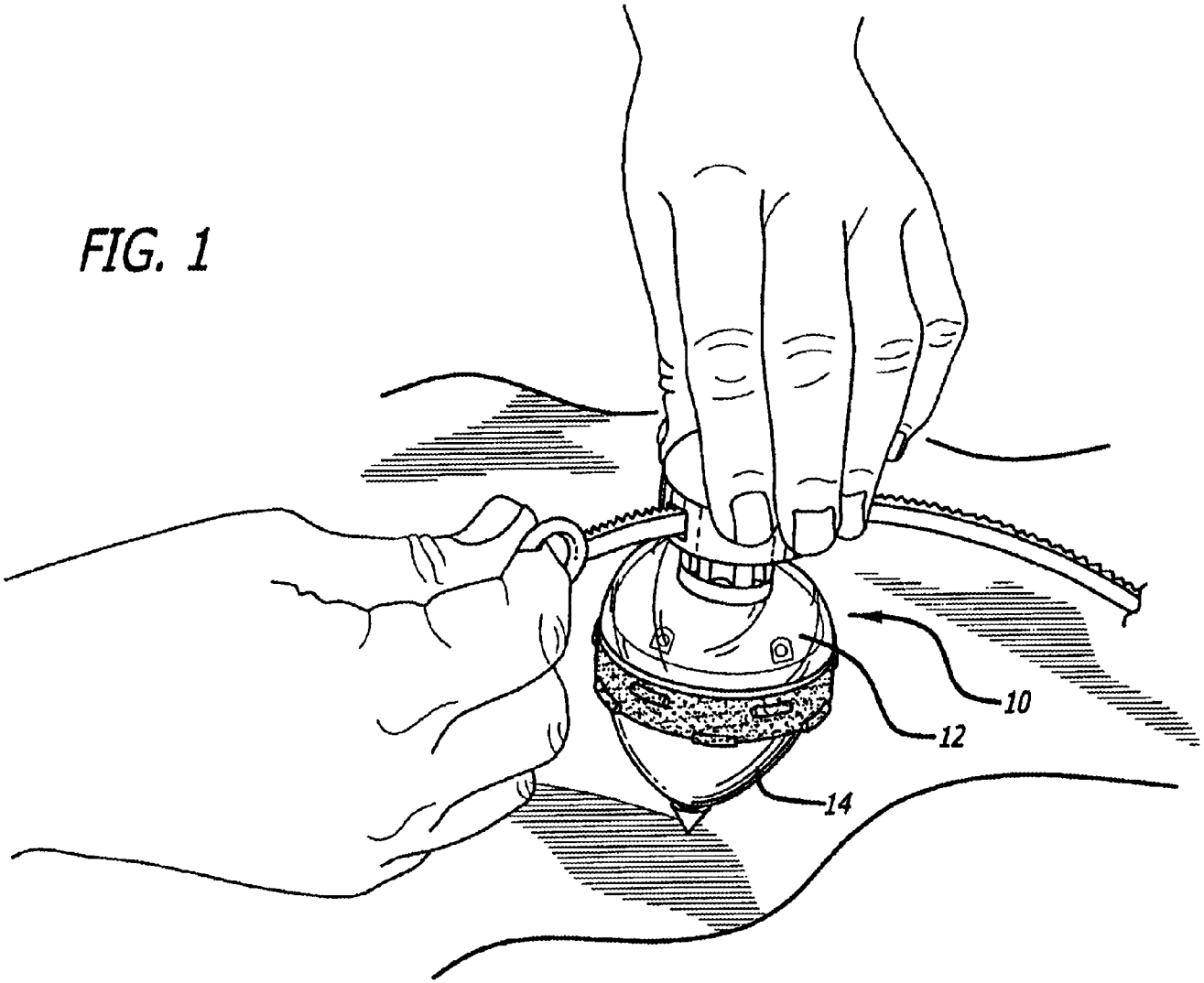
FIG. 1 is a perspective view of a top constituting a preferred embodiment of the invention and shows how a user spins the top on a support surface.

The strap 42 is provided with an integral gripping member 46 at one of its ends. The gripping member 46 may have a hollow ring-shaped configuration, although any other configuration of the gripping member may be used. A finger (FIG. 1) of the top user may be disposed in the gripping member 46 when the user desires to spin the top.

A ring 48 (FIG. 5) made from a suitable material such as aluminum or stainless steel is disposed within the cover 14 at the upper end of the cover. The ring 48 may be press fit into the inner surface of a retainer 49 which is disposed within the cover 14 and may be considered to be a part of the cover. The ring 48 offers certain advantages. It provides a weight at the approximate position where the top 10 has a maximum diameter. Thus, when the top is spun by pulling the strap 42 out of the aperture 40 in the cap 38, the ring 48 provides an enhanced inertia to the top 10. This causes the top 10 to spin for a significantly longer period of time than the top would spin if the ring 48 were not included. The ring 48 also enhances the stability of the top 10 since it widens the platform in which the top is operating. When the lugs 24*a* on the belt 22 have a substantially symmetrical relationship with respect to the lugs 24*b* on the belt 22, the belt 22 also enhances the stability of the top 10.

To operate the top 10, the strap 42 is inserted into the aperture 40 in the cap 38, with the cap separated from the support member 30. Preferably the strap 42 is fully inserted into the aperture 40 so that the gripping member 46 is disposed adjacent the cap 38. The cap 38 is then disposed on the head portion 32 with the pin 36 disposed tightly in the socket 34.

The top 10 is spun by holding the cap 30 and pulling the strap 42 out of the aperture 40. The resultant spinning of the top 10 may be accomplished by holding the cap 38 above a surface and pulling the strap 42 out of the aperture 40 in the cap 38 and then allowing the top to drop to the support surface or by disposing the top 10 on a support surface and pressing the cap downwardly on the support surface while the strap 42 pulled out of the aperture 40. The tight relationship between the top 10 and the cap 38 allows the top to be thrown outwardly and downwardly toward a support surface and to be spinning as it reaches the support surface.

The top 10 is able to spin on a support surface for long periods of time when there is no impediment preventing the top from spinning. However two (2) youngsters may be spinning tops 10 at the same time. When this occurs, the belt 22 on one of the tops 10 may strike the belt 22 or the hollow cover 14 on the other top and prevent the other top from spinning or curtail the spinning of the other top to a time shorter than the spinning time of the one top. In this way, the spinning of the top 10 has now become competitive. Before this, the spinning of a top occurred primarily on an individual basis and did not involve a competition between simultaneously spinning tops.

It will be appreciated that the belt 22 on the top 10 has primarily been provided as a weapon against the spinning of other tops. However, the belt 22 may also provide a balancing or stabilization to extend the time for the spinning of the top 10, particularly when there is no other top spinning in the same location at the same time that the one top is spinning.

It will also be appreciated that different arrangements may be provided to perform the same functions as are disclosed in this patent application. For example, a different arrangement may be provided than the cap 38 and the strap 42 extending through the aperture 40 in the cap for spinning the top 10 without departing from the scope of the invention.

The belt 22 may be considered as a collectible item. For example, individual belts may be provided with different colors and with different graphics. Individual belts 22 may also be made from different materials and may be provided with different gripping members than the ring-shaped gripping member 46 shown in the drawings. Particularly when the users of the tops constitute young children, each child may have a number of different belts 22 and may substitute one of these belts for another when he or she is competing with other children to prolong the spinning time of his or her top 10 relative to the spinning time of other tops. The children may wear the belts 22 as bracelets to indicate to others their belt collections.

FIG. 5 illustrates a modification of the embodiment shown in FIGS. 1–5. In this modification, the rotatable member 12 is formed from a clear plastic material and a plurality of lights 60 such as light emitting diodes are disposed in the rotatable member to provide an illumination. The lights 60 are connected to a battery 62 to provide an illumination. This enhances the aesthetic appearance of the top 10.

Figure 6:
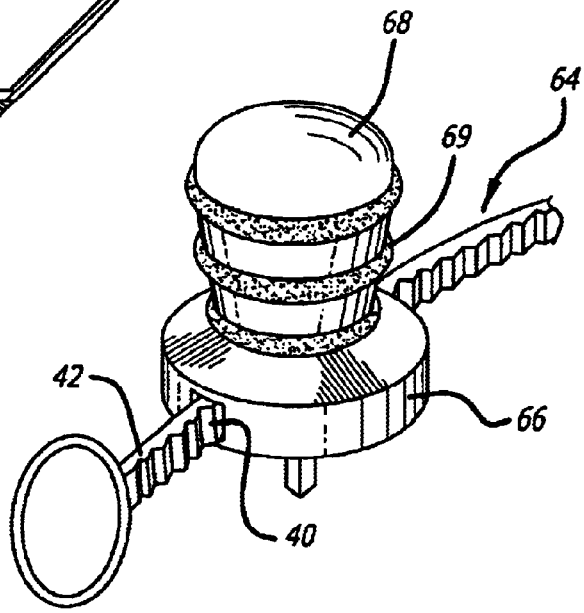
FIG. 6 is a perspective view of another preferred embodiment of the top and shows a cap having an increased vertical dimension to facilitate the spinning of the top in a vertical direction.

FIG. 6 shows a modified cap, generally indicated at 64. The cap 64 is constructed in a manner similar to that described previously in that the aperture 40 may be provided in a first portion 66, preferably cylindrical, of the cap and in that the pinion gear 39 is disposed in the aperture. In the modification shown in FIG. 6, a second portion 68 extends upwardly from the first portion 66 of the cap 64. The second portion 68 is also preferably cylindrical and preferably has a diameter less than that of the first portion 66. The second portion 68 is adapted to be manually grasped when the top 10 is to be rotated.

By displacing the second portion 68 from the strap 42, the user is able to grasp the second portion without interfering with the strap 42 when the strap is pulled from the aperture 40. The second portion 68 is also advantageous because it facilitates a vertical disposition of the top when the strap 42 is pulled from the aperture 40. This provides for a vertical disposition of the top 10 on the support surface and enhances the time during which the top spins on the support surface. The manual grasping of the second portion 68 is also facilitated by providing elements such as O-rings 69 at spaced portions in the direction of the height of the second portion. The O-rings 69 also enhance the visual appearance of the cap 64.

As previously described, the lugs 24*a* and 24*b* are provided with a symmetrical relationship when the top 10 is to have a balanced spinning operation. The lugs 24 may be considered asymmetrical when the lugs 22 are uniformly spaced from a weight standpoint around the annular periphery of the belt. However, it may be sometimes be desired for the top 10 to have an unbalanced operation. For example, the user of the top 10 may desire to have an unbalanced operation when striving to topple another top. With an unbalanced operation, the top 10 may wander more than with a balanced operation. A top with an unbalanced belt 22 may be considered as asymmetrical.

Figure 7:
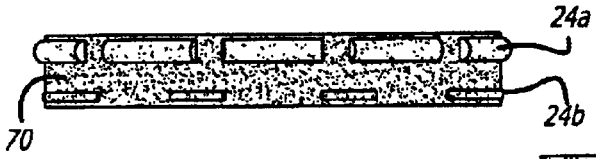
FIG. 7 is an enlarged perspective view of a belt disposed on the top and having lugs which are disposed to strike competitive tops and prevent the competitive tops from spinning and which are unevenly spaced on the belt to unbalance the belt, and to provide for a wandering of the top, hopefully toward competitive belts.

FIG. 7 shows a belt 70 in which the lugs 24*a* are different from the lugs 24*b*. In FIG. 7, the lugs 24*a* are larger and more closely spaced than the lugs 24*b*. It will be appreciated that a mixture of different sized lugs are provided at 24*a* and in which a different mixture of lugs of different sizes may be provided at 24*b*, the mixture at 24*a* being different than the mixture at 24*b*. It will also be appreciated that, although two rows of lugs are provided in FIG. 1 (the balanced arrangement) and in FIG. 7 (the unbalanced arrangement), different numbers of rows of lugs than two (2) may be provided and the number of rows of lugs may even be one (1).

Figure 8:
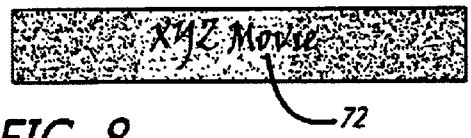
FIG. 8 is a perspective view of a belt and shows advertising (e.g. XYZ Company) on the belt, thereby enhancing the desire of users of the top to purchase as collectibles belts with different advertisements.

It will be seen that the disposition of the lugs may have an infinite number of different possibilities. Belts with different configurations of lugs may accordingly constitute collectibles to children just as, for example, different Pokemon cards may constitute collectibles to children. The urge of children to consider the belts as collectibles may also be enhanced if different graphics are provided on the belts. For example, the graphics may relate to the name of a movie as shown at 72 in FIG. 8. The graphics may also relate to movie stars or famous baseball players or to well-known characters in a wide variety of different fields.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

What is claimed is:

1. A top, including a rotary member, a cover having a frusto-conical configuration with a progressively increasing diameter and operatively coupled to the rotary member for rotary movement with the rotary member, a belt disposed on the rotary member and the cover for rotary movement with the rotary member and the cover and provided with lugs extending outwardly from the belt, a cap disposed on the rotary member and provided with an aperture and provided in the aperture with a pinion gear which rotates the rotary member, the cover and the belt, a strap extending through the aperture in the cap and disposed in operatively coupled relationship to the pinion gear in the aperture and provided with teeth to define a rack gear which rotates the pinion gear, the rotary member and the cover when the strap is pulled through the aperture in the cap, and a ring supported by the cover within the hollow interior to enhance the inertia of the top during the rotation of the top and to enhance the stability in the operation of the top during the rotation of the top.

2. A top as set forth in claim 1 wherein the lugs on the belt are symmetrically disposed on the belt to enhance the stability of the top when the top is rotated.

3. A top as set forth in claim 2 wherein the cap is removably disposed on the rotary member and wherein the strap is constructed to pass through the aperture in the cap when the cap is not disposed on the rotary member.

4. A top, including a rotary member, a cover having a frusto-conical configuration with a progressively increasing diameter and operatively coupled to the rotary member for rotary movement with the rotary member, a belt disposed on the rotary member and the cover for rotary movement with the rotary member and the lover and provided with lugs extending outwardly from the belt, a cap disposed on the rotary member and provided with an aperture and provided in the aperture with a pinion gear which rotates the rotary member, the cover and the belt, a strap extending through the aperture in the cap and disposed in operatively coupled relationship to the pinion gear in the aperture and provided with teeth to define a rack gear which rotates the pinion gear, the rotary member and the cover when the strap is pulled through the aperture in the cap, and a ring supported by the coyer within the hollow interior to enhance the inertia of the top during the rotation of the top and to enhance the stability in the operation of the top during the rotation of the top wherein the cover has a frusto-conical configuration with a progressively increasing diameter and wherein the ring is supported within the cover at a position of an optimal diameter of the cover to enhance the inertia of the top and to enhance the stability in the operation of the top during the rotation of the top.

5. A top, including a rotary member, a cover having a frusto-conical configuration with a progressively increasing diameter and operatively coupled to the rotary member for rotary movement with the rotary member, a belt disposed on the rotary member and the cover for rotary movement with the rotary member and the cover and provided with lugs extending outwardly from the belt, a cap disposed on the rotary member and provided with an aperture and provided in the aperture with a pinion gear which rotates the rotary member, the cover and the belt, a strap extending through the aperture in the cap and disposed in operatively coupled relationship to the pinion gear in the aperture and provided with teeth to define a rack gear which rotates the pinion gear, the rotary member and the cover when the strap is pulled through the aperture in the cap, and a ring supported by the cover within the hollow interior to enhance the inertia of the top during the rotation of the top and to enhance the stability in the operation of the top during the rotation of the top wherein the cap is removably disposed on the rotary member and wherein the strap is constructed to pass through the aperture in the cap when the cap is not disposed on the rotary member.

6. A top, including apparatus constructed to spin on a support surface, a belt disposed on the apparatus and extending from the apparatus and constructed to actuate other tops, while spinning, to inhibit the other tops from spinning, and a ring disposed within the apparatus and supported by the apparatus to enhance the inertia of the top and to facilitate the balancing of the top.

7. A top as set forth in claim 6, including, a strap, and a cap having an aperture for receiving the strap and constructed to be disposed on the apparatus with the strap extending through the aperture to provide a rotation of the top when the strap is removed from the aperture.

8. A top as set forth in claim 7 wherein the strap is movable in the aperture, when the cap is disposed on the apparatus, to rotate the apparatus.

9. A top as set forth in claim 7 wherein a belt is disposed on the apparatus and is provided with spaced lugs around its periphery to enhance the stability of the apparatus and to strike other tops and prevent the other tops from spinning.

10. A top asset forth in claim 8 wherein a belt is disposed on the apparatus and is provided with lugs around its periphery to enhance the stability of the apparatus and to strike other tops and prevent the other tops from spinning.

11. A top as set forth in claim 6 wherein the apparatus is shaped to provide a frusto-conical configuration having an increasing diameter and wherein the ring is disposed on the apparatus at the position of substantially the maximum diameter of the frusto-conical configuration.

12. A top as set forth in claim 10 wherein the apparatus is shaped to provide a frusto-conical configuration having an increasing diameter and wherein the ring is disposed on the apparatus at the position of substantially the maximum diameter of the frusto-conical configuration.

13. A top, including a hollow rotatable member having a variable diameter at different positions on the member and having a position of maximum diameter, a cap disposed on the rotatable member at the upper end of the rotatable member for movement with the rotatable member and provided with an aperture and with a pinion gear in the aperture, a strap supported by the cap for movement with the rotatable member and having teeth on one surface to define a rack gear meshing with the pinion gear to rotate the pinion gear when the strap is pulled through the aperture, and a ring supported within the hollow body at the position of maximum diameter to enhance the inertia of the top.

14. A top as set forth in claim 13 wherein the diameter of the hollow rotatable member progressively decreases and wherein the ring is supported within the hollow rotatable body at a position of a maximal diameter within the hollow rotatable member.

15. A top as set forth in claim 1 wherein the diameter of the hollow rotatable member progressively decreases and wherein the ring is supported with the hollow rotatable member at a position of a maximal diameter within the hollow rotatable member.

16. A top as set forth in claim 13 wherein the ring is disposed on the rotatable member at a position near the position of the maximum diameter of the rotatable member to add weight to the top and enhance the inertia of the top, thereby extending the time during which top spins.

17. A top as set forth in claim 16 wherein the rotatable member is made from a plastic material and the ring is made from a metallic material.

18. A top as set forth in claim 13 wherein the cap is provided with a first portion in which the aperture is provided and the pinion gear is disposed in the aperture and wherein the strap is disposed in the aperture in the first portion and wherein the cap is provided with a second portion extending upwardly from the first portion to facilitate the manual grasping of the cap and to facilitate the disposition of the top in a vertical position when the strap is pulled through the aperture in the first portion of the cap.

19. A top as set forth in claim 18 wherein the cap is cylindrical and wherein the second portion of the cap has a smaller diameter than the first portion of the cap.

20. A top as set forth in claim 17 wherein the cap is provided with a first portion in which the aperture is provided and in which the pinion gear is disposed in the aperture and wherein the strap is disposed in the aperture in the first portion of the cap and wherein the cap is provided with a second portion extending upwardly from the first portion to facilitate the manual grasping of the cap and to facilitate the disposition of the top in a vertical position when the strap is pulled through the aperture in the first portion of the cap and wherein the cap is cylindrical and the second portion of the cap has a smaller diameter than the first portion of the cap.

21. A top, including:

a hollow member rotatable on a support surface, the member having a variable radius at different positions on the member, a cap disposed on the rotatable member in a tightly fitting relationship with the rotatable member, the cap having a first portion with an aperture and a pinion gear in the aperture and having a second portion extending upwardly from the first portion with a configuration to facilitate the manual grasping of the cap at the second portion, the pinion gear being coupled to the hollow rotatable member to produce a rotation of the hollow rotatable member in accordance with the rotation of the pinion gear, a strap having teeth at one end to define a rack gear, the strap being disposed in the aperture for a coupling of the rack gear and the pinion to produce a rotation of the pinion gear when the strap is pulled through the aperture, and a ring supported by the member at a position within the member of a maximal radius of the member to enhance the inertia of the top while the top is rotating.

22. A top, including:

a hollow member rotatable on a support surface, a cap disposed on the rotatable member in a tightly fitting relationship with the rotatable member, the cap having a first portion with an aperture and a pinion gear in the aperture and having a second portion extending upwardly from the first portion with a configuration to facilitate the manual grasping of the cap at the second portion, the pinion gear being coupled to the hollow rotatable member to produce a rotation of the hollow rotatable member in accordance with the rotation of the pinion gear, and a strap having teeth at one end to define a rack gear, the strap being disposed in the aperture for a coupling of the rack gear and the pinion to produce a rotation of the pinion gear when the strap is pulled through the aperture, wherein the first and second portions of the cap have a substantially cylindrical configuration and wherein the second portion of the cap has a smaller diameter than the first portion of the cap and wherein elements are disposed on the second portion of the cap to facilitate the manual gripping of the second portion of the cap when the cap is to be spun.

23. A top, including:

a hollow member rotatable on a support surface, a cap disposed on the rotatable member in a tightly fitting relationship with the rotatable member, the cap having a first portion with an aperture and a pinion gear in the aperture and having a second portion extending upwardly from the first portion with a configuration to facilitate the manual grasping of the cap at the second portion, the pinion gear being coupled to the hollow rotatable member to produce a rotation of the hollow rotatable member in accordance with the rotation of the pinion gear, and a strap having teeth at one end to define a rack gear, the strap being disposed in the aperture for a coupling of the rack gear and the pinion to produce a rotation of the pinion gear when the strap is pulled through the aperture elements are disposed on the second portion of the cap to facilitate the manual grasping of the second portion of the cap in a vertical direction when the strap is to be pulled out of the aperture in the cap to spin the top.

24. A top as set forth in claim 21 including a belt disposed on the hollow rotatable member and provided with externally disposed lugs to strike another spinning top and prevent the other top from spinning.

25. A top as set forth in claim 24, wherein the lugs are disposed in a symmetrical relationship on the belt to stabilize and balance the top.

26. A top as set forth in claim 24 wherein the lugs are disposed in a non-symmetrical relationship on the belt to destabilize and unbalance the top in a particular manner.

27. A top as set forth in claim 21 wherein the rotatable member is made from a clear plastic material and lights are disposed in the rotatable member to provide an illumination inside the rotary member.

28. A top, including:

a hollow member rotatable on a support surface, a cap disposed on the rotatable member in a tightly fitting relationship with the rotatable member, the cap having a first portion with an aperture and a pinion gear in the aperture and having a second portion extending upwardly from the first portion with a configuration to facilitate the manual grasping of the cap at the second portion, the pinion gear being coupled to the hollow rotatable member to produce a rotation of the hollow rotatable member in accordance with the rotation of the pinion gear, and a strap having teeth at one end to define a rack gear, the strap being disposed in the aperture for a coupling of the rack gear and the pinion to produce a rotation of the pinion gear when the strap is pulled through the aperture the first and second portions of the cap have a substantially cylindrical configuration and wherein the second portion of the cap has a smaller diameter than the first portion of the cap and wherein elements are disposed on the second portion of the cap to facilitate the manual gripping of the second portion of the cap when the cap is to be spun elements are disposed on the second portion of the cap to facilitate the manual grasping of the second portion of the cap to facilitate the manual grasping of the second portion of the cap in a vertical direction when the strap is to be pulled out of the aperture in the cap to spin the top and wherein, a belt is disposed on the hollow rotatable member and provided with externally disposed lugs to strike another spinning top and prevent the other top from spinning and wherein the rotatable member is made from a clear plastic material and lights are disposed in the rotatable member to provide an illumination inside the rotary member.

29. A top as set forth in claim 28 wherein the lugs are disposed in a symmetrical relationship on the belt to stabilize and balance the top.

30. A top as set forth in claim 28 wherein the lugs are disposed in a non-symmetrical relationship on the belt to destabilize and unbalance the top.

31. A top, including a rotatable member including a socket at the top of the member, a cap having a pin constructed to fit tightly into the socket in the member, there being an aperture in the cap and a pinion gear in the aperture to rotate the rotatable member as the pinion gear rotates, and a strap positionable in the aperture in the cap and having teeth on one of its surfaces to define a rack gear for engaging the pinion gear and to rotate the pinion gear as the strap is pulled through the aperture in a direction to remove the strap from the aperture.

32. A top as set forth in claim 31, including the tight relationship between the gear and the socket providing for the top to be thrown outwardly and downwardly toward a support surface and to be spinning as it reaches the support surface.

33. A top as set forth in claim 31 wherein the cap is cylindrical and has a first portion which includes the aperture and the pinion in the aperture and has a second portion extending upwardly from the first portion to provide for a manual grasping of the second portion when the top is to be spun.

34. A top as set forth in claim 33 wherein elements are disposed in the second portion of the cap at vertically spaced positions to facilitate the manual grasping of the second portion of the cap when the top is to be spun.

35. A top as set forth in claim 31 wherein a belt is disposed on the rotatable member and is provided with externally disposed lugs to facilitate a contact with other tops for preventing the other tops from rotating.

36. A top as set forth in claim 35 wherein the tight relationship between the gear and the socket provide for the top to be thrown outwardly and downwardly toward a support surface and to be spinning as it reaches the support surface and wherein the cap is cylindrical and has a first portion which includes the aperture and the pinion in the aperture and has a second portion extending upwardly from the first portion to provide for a manual grasping of the second portion when the top is to be spun, and wherein elements are disposed in the second portion of the cap at vertically spaced positions to facilitate the manual grasping of the second portion of the cap when the top is to be spun.

37. A top as set forth in claim 31 wherein the rotatable member is hollow and has a frusto-conical configuration with a maximum diameter in the frusto-conical configuration and wherein a ring is disposed in the rotatable member at substantially the position of the maximum diameter to provide inertia to the top as the top spins and to provide an enhanced balance and stability in the top.

38. A top as set forth in claim 37 wherein the tight relationship between the gear and the socket provide for the top to be thrown outwardly and downwardly toward a support surface and to be spinning as it reaches the support surface and wherein the cap is cylindrical and has a first portion which includes the aperture and the pinion in the aperture and has a second portion extending upwardly from the first portion to provide for a manual grasping of the second portion when the top is to be spun and wherein elements are disposed in the second portion of the cap at vertically spaced positions to facilitate the manual grasping of the second portion of the cap when the top is to be spun.

39. A top as set forth in claim 38 wherein a belt is disposed on the rotatable member and is provided with externally disposed lugs to facilitate a contact with other tops for preventing the other tops from rotating.

* * * * *

UNITED STATES PATENT AND TRADEMARK OFFICE

CERTIFICATE OF CORRECTION

PATENT NO. : 6,666,743 B2
DATED : December 23, 2003
INVENTOR(S) : Carrie L. Polare et al.

It is certified that error appears in the above-identified patent and that said Letters Patent is hereby corrected as shown below:

Title page,
Item [73], Assignee, delete "Sport Fun, Inc.", and insert -- 2COOL CORPORATION --.

Column 6,
Line 46, delete "lover", and insert -- cover --.
Line 58, delete "coyer", and insert -- cover --.

Column 7,
Line 53, delete "asset", and insert -- as set --.

Signed and Sealed this

Eighteenth Day of May, 2004

JON W. DUDAS
*Acting Director of the United States Patent and Trademark Office*